US007897262B1

(12) United States Patent
Chambers

(10) Patent No.: US 7,897,262 B1
(45) Date of Patent: Mar. 1, 2011

(54) WALL DECORATION

(76) Inventor: James E. Chambers, Manawa, WI (US)

( * ) Notice: Subject to any disclaimer, the term of this patent is extended or adjusted under 35 U.S.C. 154(b) by 807 days.

(21) Appl. No.: 11/652,698

(22) Filed: Jan. 12, 2007

(51) Int. Cl.

| | |
|---|---|
| ***A47G 35/00*** | (2006.01) |
| ***B60R 13/00*** | (2006.01) |
| ***A47F 3/00*** | (2006.01) |
| ***A47G 1/06*** | (2006.01) |

(52) U.S. Cl. ..... 428/542.2; 428/542.4; 428/31; 312/114; 40/765

(58) Field of Classification Search ..... None
See application file for complete search history.

(56) References Cited

U.S. PATENT DOCUMENTS

D308,113 S 5/1990 Lewis, Jr.
5,993,031 A 11/1999 Krise
6,132,821 A 10/2000 Gare
7,018,006 B1 * 3/2006 Tezak ..... 312/114
2002/0166939 A1 * 11/2002 Plein et al. ..... 248/469

* cited by examiner

*Primary Examiner* — Gordon R Baldwin
(74) *Attorney, Agent, or Firm* — Russell L Johnson Patent Agent

(57) ABSTRACT

The wall decoration of this invention is a molded fiberglass replica of a portion of a classic vehicle attached to an internally positioned mounting plate such that when attached to a wall the replica appears to be imbedded in the wall. The mounting plate is secured to a wall by means of a Z-bracket that is accessible through an openable panel in the replica. The mounting plate and Z-bracket mounting provide sturdy structural support for the replica and for a variety of internally disposed accessories for the replica as well as other utilities the owner might whish to incorporate to personalize the replica.

6 Claims, 4 Drawing Sheets

WALL DECORATION

BACKGROUND OF THE INVENTION

1. Field of the Invention

This invention relates to a three dimensional wall decoration that is a replica of a portion of a classic vehicle.

More specifically this invention relates to a wall decoration as described above wherein the wall decoration is a light weight but sturdy replica of a portion of a classic vehicle secured around the perimeter of a sturdy mounting plate which is secured to a wall so that the replica appears to be projecting out of the wall.

Still more specifically this invention relates to a wall decoration described above wherein the replica is provided with an openable panel which provides access to the wall decoration mounting means and to accessories contained inside the replica.

2. Background of the Invention

Lovers of classic automobiles often decorate their homes and offices with pictures and miniatures and other artifacts in the image of the classic cars of their interests.

It would be costly and abhorrent to cut up a classic car to acquire a portion of the car for a wall decoration. There are also structural limitations to supporting the metal parts of a vehicle on a wall. Further, mounting a portion of a classic car on a plaque in the style of a hunting trophy would not be in keeping with the esteem that classic car enthusiasts have for their vehicles.

The wall decoration of this invention addresses the problems cited above by providing a molded replica of a portion of a classic vehicle attached to an internally positioned mounting plate such that when attached to a wall the replica appears to be imbedded in the wall. The mounting plate is secured to a wall by means of a Z-bracket that is accessible through an openable panel in the replica. The mounting plate and Z-bracket mounting provide sturdy structural support for the replica and for a variety of internally disposed accessories for the replica as well as other utilities the owner might wish to incorporate to personalize the replica.

BRIEF DESCRIPTION OF THE PRIOR ART

U.S. Design Pat. No. 308,113 to Lewis Jr. discloses a decorative wall lamp having a portion of an automobile projecting outward from a stellate plaque.

U.S. Pat. No. 5,993,031 to Krise discloses a simulated automobile hood light having an openable panel that provides access to the interior of the hood light which is mounted on a bottom member. Krise also discloses shelves for displaying miniatures which are exterior to the simulated hood light on an extension of the bottom member.

U.S. Pat. No. 6,132,821 to Garr discloses a three dimensional sculpted wall adornment made of soft flexible molded plastic that is readily attached to and removed from a wall without damage to the surface.

U.S. Pat. No. US 2002/0166939 A1 to Plein II et al. discloses systems and methods for mounting frameless wall décor articles. One of the mounting systems taught involves a Z-bracket having the same shape as the Z-bracket of the instant invention.

BRIEF DESCRIPTION OF THE INVENTION

A wall decoration comprising: a molded replica of a portion of a classic vehicle having a perimeter edge lying in a single plane, and a back plate shaped to fit inside the molded replica and secured to the molded replica around the perimeter edge of the replica, and an openable panel which is a part of the molded replica and provides access to the interior of the wall decoration, and at least one Z-bracket fixedly securable to a wall structure, and at least one mounting slot formed in the back plate that will pass over the Z-bracket when the Z-bracket is secured to a wall so that the mounting plate and the wall are proximal when the mounting plate is resting in the Z-bracket.

DETAILED DESCRIPTION OF THE INVENTION

Figure 1:
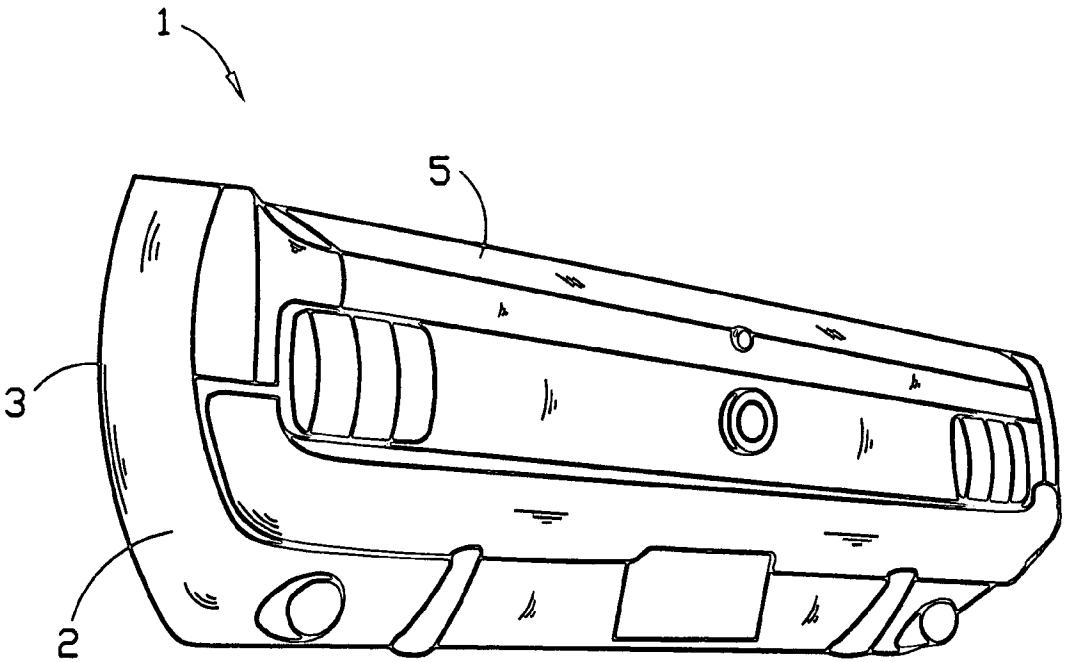
FIG. 1 is a perspective view of an embodiment of wall decoration of this invention involving a replica of the rear portion of a classic automobile.

In the drawings like numbers refer to like objects and the proportions of some elements of the invention have been modified to facilitate illustration.

The term "proximal" as used herein shall be read to mean; "1: situated close to: 2: next to or nearest . . . "

The inventive concept is illustrated in FIGS. 1-4 as a wall decoration 1 comprising: a molded replica 2 of a portion of a classic vehicle having a perimeter edge 3 lying in a single plane, and a back plate 4 shaped to fit inside the molded replica 2 and secured to molded replica 2 around the perimeter edge 3 of replica 2, and an openable panel 5 which is a part of the molded replica 2 and which provides access to the interior of wall decoration 1, and at least one Z-bracket 6 fixedly securable to a wall 8 structure, and at least one mounting slot 7 formed in the back plate 4 that will pass over the Z-bracket 6 when the Z-bracket 6 is secured to a wall 8 so that the back plate 4 and the wall 8 are proximal when back plate 4 is resting in the Z-bracket 6.

Replica 2 is typically formed of molded fiber glass, composite material, or plastic formed in a pattern taken from a classic vehicle. Replica 2 may be a scaled up or scaled down replica but a full scale replica is preferred. The replica of FIGS. 1-4 is taken from a 1965 Ford Mustang. Because the replica is full scale, the replica can be provided with authentic accessories such as, molding, trim, decals, logos, license plates and the like that enables the owner to both personalize the replica and to make it a true and authentic replica of a portion the original classic vehicle.

When replica 2 is a full scale side elevation of a classic automobile the replica may extend beyond ten feet in length and three feet in height. Back plate 4 must serve two objectives. First it must provide structural strength to wall decoration 1. Second it must hold wall decoration 1 snugly to wall 8 along the length and height of replica 2.

Figure 2:
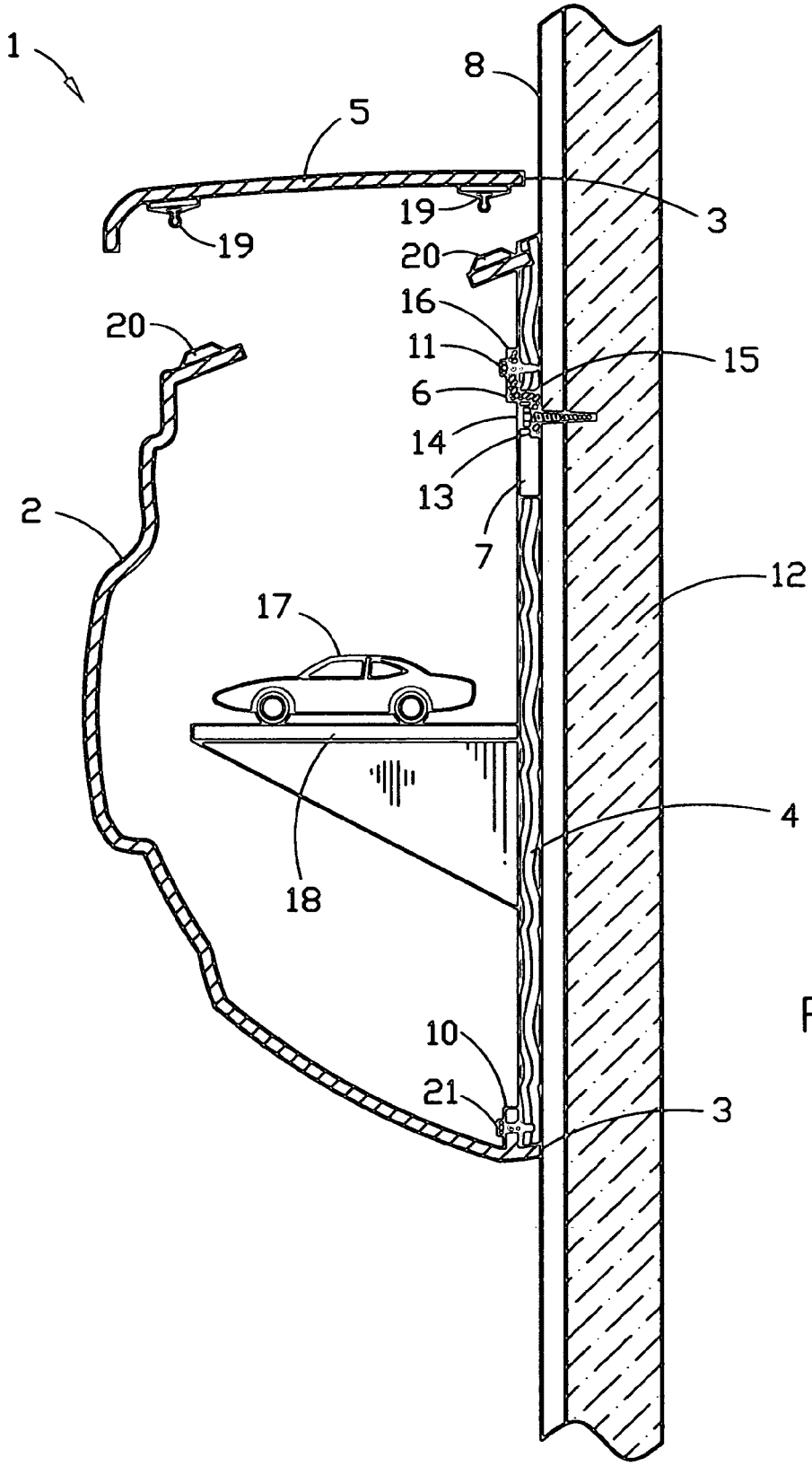
FIG. 2 is an exploded view of the wall decoration of FIG. 1.

Back plate 4 may be made of metal or of plastic but plywood is preferred. Back plate 4 may be secured in place around the perimeter edge 3 of replica 2 by fasteners 21 passing through flange 10 as shown in FIG. 2, but adhesive bonding is preferred. When replica 2 is secured around its perimeter edge 3 to back plate 4, the assembly of the two becomes quite stiff.

Back plate 4 is provided with an elongate mounting slot 7 which is preferably longer than the spacing between two studs 12 in conventional wall construction. Z-bracket 7 has a wall engaging segment 13 which is secured to two adjacent studs 12 with nails or threaded fasteners such as lag screws 14. Z-bracket 7 also has a lateral segment 15 and a back plate engaging segment 16. When back plate 4 rests on lateral segment 15, back plate 4 and wall 8 are proximal and perimeter edge 3 of replica 2 is in contact with wall 8 giving wall decoration 1 the appearance of projecting out of wall 8.

Z-bracket 6 may be secured to back plate 4 by means of nails or threaded fasteners such as screws 11 which are accessed through openable panel 5. The size of replica 1 may require that more than one mounting slot and Z-bracket be employed to mount replica 2 on wall 8.

Figure 3:
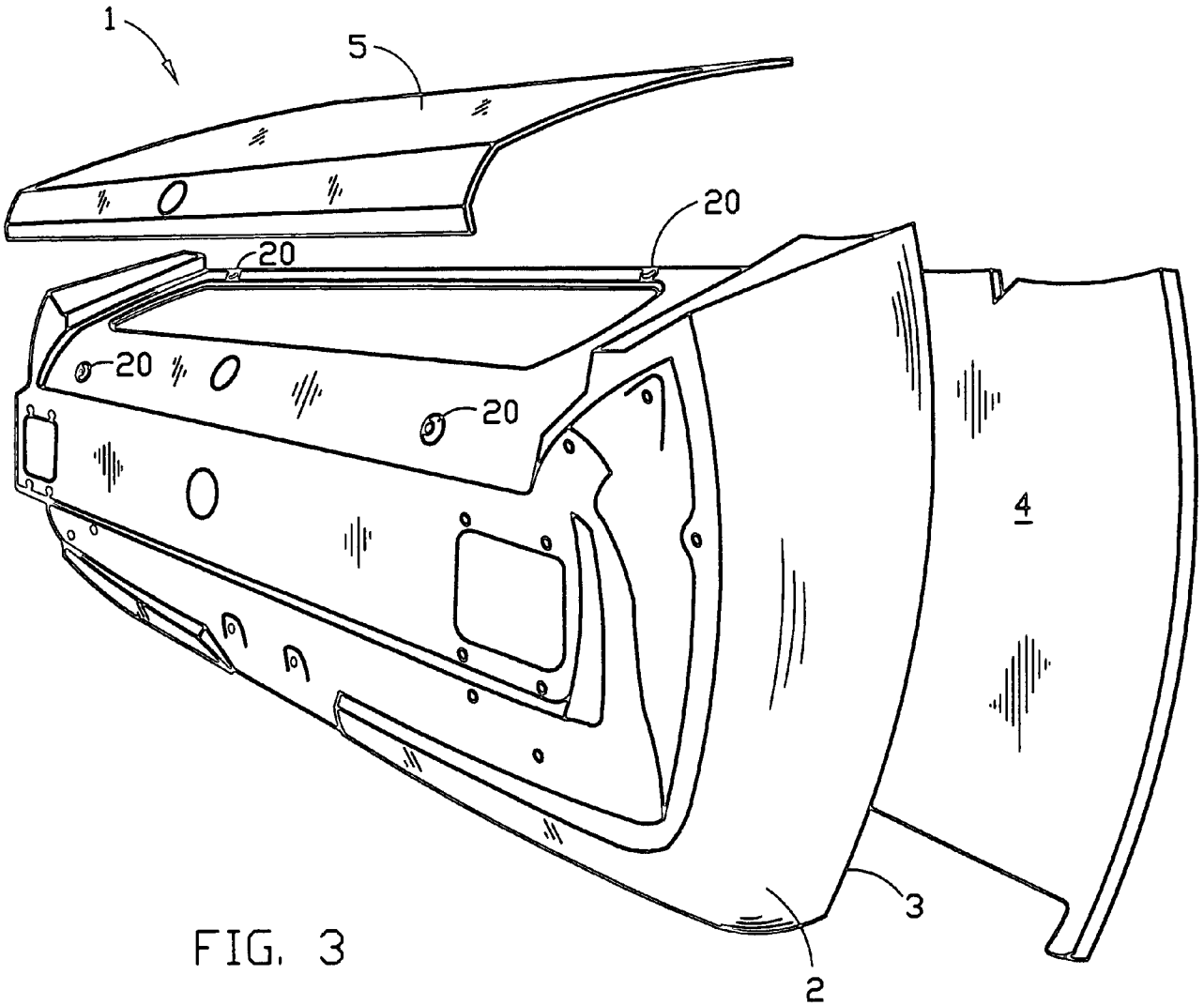
FIG. 3 is an elevation cross sectional view of the wall decoration of FIG. 1.
Figure 4:
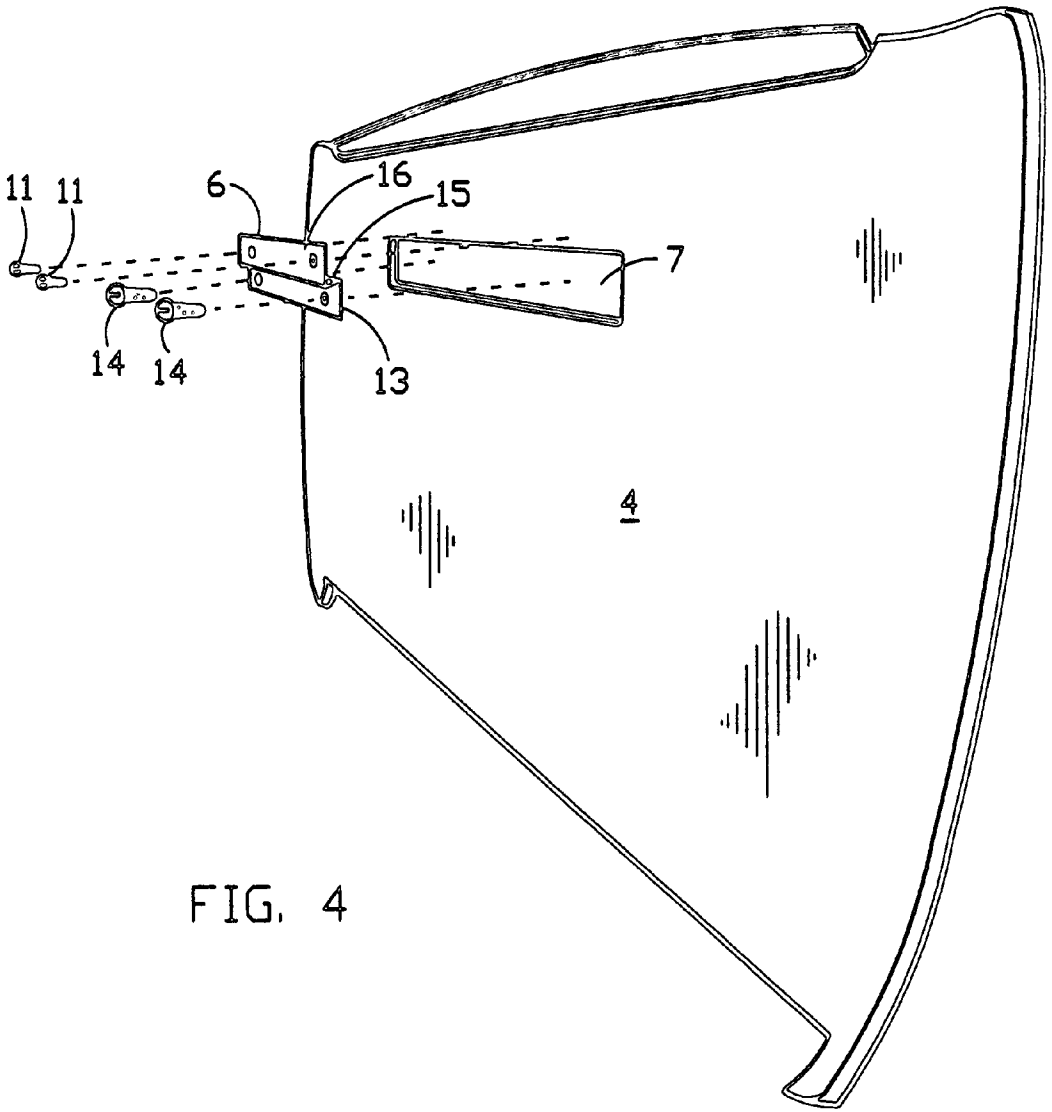
FIG. 4 is an exploded view of the mounting plate and mounting bracket for the wall decoration of FIG. 1.

Openable panel 5 is shown to be provided with pins 19 which engage receivers 20 to locate panel 5 on replica 2. Panel 5 may be removable as shown in FIGS. 2 and 3 or it may be hinged (not shown), but a removable panel is preferred.

The above disclosures are enabling and would permit one skilled in the art to make and use the invention for its intended purposes without undue experimentation. However, the invention permits the user to personalize the invention in numerous ways.

The mounting of back plate 4 to wall 8 is sturdy enough to support a wide variety of utilities and accessories inside the replica. Referring now to FIG. 2 wherein a shelf 18 is shown to be secured to back plate 4 and serves to display miniature cars 19. Shelf 18 or similar supports can enable the provision of electronics such as a radio or speakers and music playing electronics as well as supporting books, or pictures or utilities of the user's choice.

While the inventor has disclosed representative examples of his invention it should be understood that the invention admits of numerous variants without departing from the scope of the invention. The scope of the invention should not be limited to the examples cited but should only be limited by the scope of the appended claims and all equivalents thereto would be rendered obvious thereby to one skilled in the art.

What is claimed is:

1. A wall decoration comprising:

a) a molded replica of a portion of a classic vehicle having a perimeter edge lying in a single plane, b) a back plate shaped to fit inside the molded replica and secured to the molded replica around the perimeter edge of the replica, c) an openable panel which is a part of the molded replica and which provides access to the interior of the wall decoration, when the wall decoration is mounted on a wall, d) at least one Z-bracket fixedly securable to a wall structure, and e) at least one mounting slot formed in the back plate that will pass over the Z-bracket when the Z-bracket is secured to a wall so that the back plate and the wall are proximal when the back plate is resting in the Z-bracket.

2. The wall decoration of claim 1 wherein the replica is a full scale replica molded in a pattern taken from a classic vehicle.

3. The wall decoration of claim 1 wherein the back plate is made of plywood and secured in place in the replica by adhesive bonding.

4. The wall decoration of claim 1 wherein the mounting slot in the back plate is larger than the Z-bracket.

5. The wall decoration of claim 1 wherein the back plate is provided with supports for accessories.

6. A wall decoration comprising:

a) a full scale molded replica of a portion of a classic vehicle having a perimeter edge lying in a single plane, and, wherein the replica is molded on a pattern taken from a classic vehicle, b) a back plate shaped to fit inside the molded replica and secured to the molded replica around the perimeter edge of the replica, and wherein the back plate is made of plywood and secured in place in the replica by adhesive bonding, c) an openable panel which is a part of the molded replica and which provides access to the interior of the wall decoration, when the wall decoration is mounted on a wall, d) at least one Z-bracket fixedly securable to a wall structure, and e) at least one mounting slot formed in the back plate that will pass over the Z-bracket when the Z-bracket is secured to a wall so that the back plate and the wall are proximal when the back plate is resting in the Z-bracket.

* * * * *